US005936594A

United States Patent [19]

Yu et al.

[11] Patent Number: 5,936,594

[45] Date of Patent: Aug. 10, 1999

[54] HIGHLY ISOLATED MULTIPLE FREQUENCY BAND ANTENNA

[75] Inventors: I-Ping Yu, Tucson, Ariz.; Gary Salvail, Camarillo, Calif.

[73] Assignee: Raytheon Company, Lexington, Mass.

[21] Appl. No.: 08/819,248

[22] Filed: May 17, 1997

[51] Int. Cl.[6] ..... H01Q 1/36

[52] U.S. Cl. ..... 343/895

[58] Field of Search ..... 343/895; H01Q 1/36

[56] References Cited

U.S. PATENT DOCUMENTS 3,683,385 8/1972 Corzine et al. ..... 343/895

5,619,218 4/1997 Salvail et al. ..... 343/895

*Primary Examiner*—Michael C. Wimer

*Attorney, Agent, or Firm*—David W. Collins; Andrew J. Rudd; Glenn H. Lenzen, Jr.

[57] ABSTRACT

A multiple frequency band, multi-spiral antenna that employs filters to pass the band of one spiral and reject the band of the other spirals. Additional isolation is achieved by arranging adjacent spirals to have opposite senses. All the isolation and filtering is accomplished within the body of the antenna. The antenna includes two, two-arm spirals. The higher frequency spiral resides in the interior of the lower frequency spiral. The two spirals are concentric about each other, and lie on the same plane. A balun and filter circuit is connected to the two spirals, and is disposed within the antenna body.

21 Claims, 2 Drawing Sheets

HIGHLY ISOLATED MULTIPLE FREQUENCY BAND ANTENNA

This invention was made with Government support under Contract No. N00024-95-C-5400 awarded by the Department of the Navy. The Government has certain rights in this invention.

TECHNICAL FIELD OF THE INVENTION

This invention relates to the field of microwave antennas, and more particularly to a multiple frequency band antenna with isolation between the bands.

BACKGROUND OF THE INVENTION

Antennas having the capability of multiple frequency band operation are known in the art. It is desirable to provide isolation between the multiple frequency bands. Conventionally this is done by filtering the bands by filters outside the antenna body, which requires added hardware and space.

It would be advantageous to provide a multiple frequency band antenna having isolation between the bands achieved within the body of the antenna.

SUMMARY OF THE INVENTION

A multiple frequency band antenna system with isolation between multiple frequency bands of operation is described. The system includes an interior spiral antenna comprising a pair of spiral arms wound around a center axis. The points of equal radius of the two spiral arms are on opposite sides of the center, or 180 degrees apart. The invention is not limited to two arm spirals; additional arms can be used with the proper mode formers. The interior spiral antenna is for operation at a first frequency band. An outer spiral antenna includes another pair of outwardly spiraling arms positioned 180 degrees apart. Each spiral arm has a feed end and a termination end. The outer spiral antenna operates at a second frequency band which is lower than the first frequency band. The interior and outer spiral antennas are concentric about each other and are disposed on a common plane. The addition of more spirals concentrically arranged is limited only by space constraints.

The antenna system further includes a balun and filter circuit, comprising a first balun including a first transmission line circuit for connecting a first frequency band drive signal to the pair of arms for the interior spiral antenna. A second balun includes a second transmission line circuit for feeding a second frequency band drive signal to the arms of the outer spiral antenna.

A filter circuit provides isolation between signals of the first frequency band and the second frequency band. In a preferred embodiment, the filter circuit includes a bandpass filter comprising the first transmission line circuit with, say, 70 dB rejection of the second drive signal. Additional isolation is obtained by operating the inner and outer spirals in opposite circular polarization senses. While this manner of operating the spirals theoretically provides infinite isolation, at least 20 dB of additional isolation is achieved. Thus, in an exemplary embodiment, at least 90 dB of rejection of the second signal by the first spiral is provided. If additional spirals and filters were to be used for more than two bands of operation, the additional spirals could also be arranged so that each neighboring antenna had opposite polarization.

The interior and outer spiral antennas and the balun and filter circuit are disposed within the antenna body.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

Figure 1:
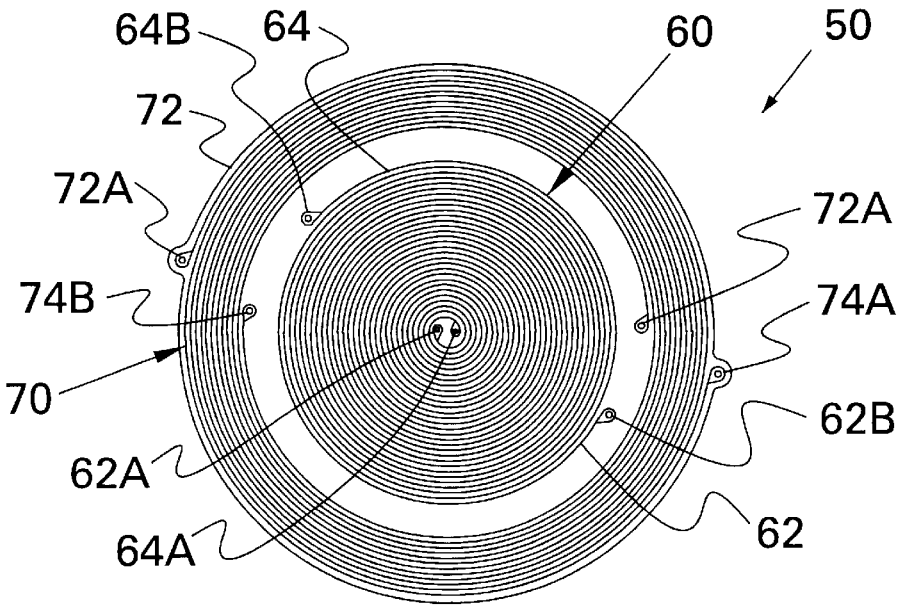
FIG. 1 is a top view of a multiple frequency band antenna embodying the invention.

FIG. 1 illustrates an exemplary embodiment of a multiple frequency band antenna 50 embodying the invention. The antenna 50 is a multi-spiral antenna that employs filters to pass the band of one spiral and reject the band of the other spirals. Additional isolation is achieved by arranging adjacent spirals to have opposite senses. An important aspect of the invention is that all the isolation and filtering is accomplished within the body of the antenna.

The antenna 50 includes 2 two-arm spirals 60 and 70 in this exemplary configuration. The higher frequency spiral 60 resides in the interior of the lower frequency spiral 70. The interior spiral 60 includes two spiral wound arms 62, 64, each formed by conductor patterns etched on a copper clad printed circuit board, in an exemplary implementation. The interior spiral 60 is center fed by signals input at microstrip pads 62A, 64A connected at the interior ends of the spiral arms 62, 64. The arms terminate at the outer end of the spiral with microstrip pads 62B, 64B used for attaching terminating resistors.

The outer spiral 70 includes two spiral wound arms 72, 74, each formed by conductive paths, and is fed from the outside by signals input at microstrip pads 72A, 74A. The arms 72, 74 terminate at microstrip pads 72B, 74B for terminating resistors.

The resistors are connected between the spiral plane represented by the paper on which FIG. 1 appears, and the system ground, by way of coaxial cables coming up through the antenna body. The use of resistors or other terminating methods is not critical to this invention. The system will function without resistors, but not as well. The resistors attenuate the energy that does not radiate that would otherwise reach the end of the spiral arms and reflect back to interfere with the incident energy. A lack of resistors becomes most noticeable when the region of radiation is near the end of the spiral arms and the energy has a short path length before it is bounced back into the incoming signal.

It is also noted that the outer spiral could alternatively be fed from the inner terminations of the spiral arms.

Both spiral antennas 60 and 70 are fed by coaxial cables which join the spirals to the baluns which are contained on a stripline board within the antenna body. The use of coaxial cables is not critical; striplines or other suitable transmission lines could be used.

Figure 2:
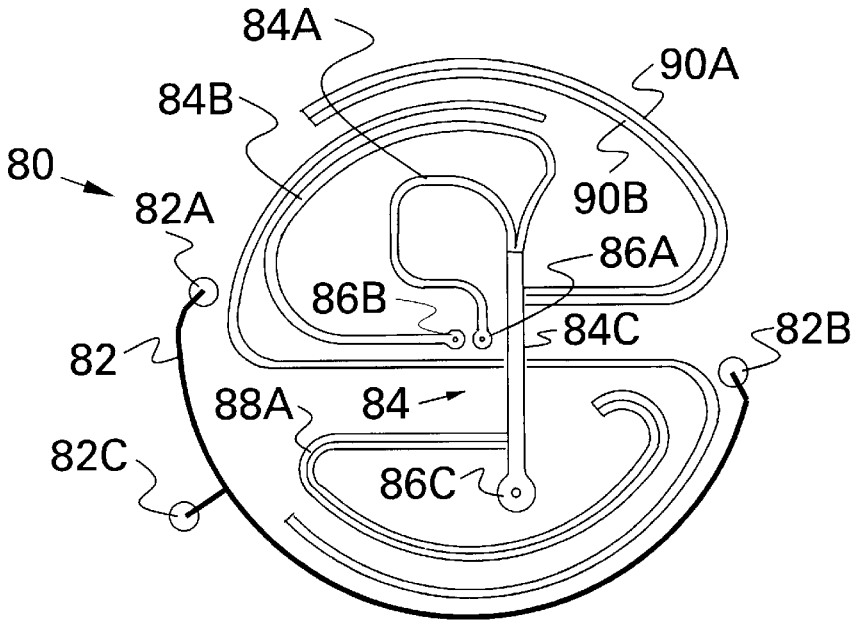
FIG. 2 illustrates the balun and filter layout for the antenna of FIG. 1.

FIG. 2 illustrates the balun and filter layout 80 for the antenna 50. Conductor line 82 with three large pads 82A, 82B and 82C is the balun for the low frequency antenna 70. Pad 82A is connected by a coaxial cable to pad 72A of the arm 72. Pad 82B is connected by a coaxial cable to pad 74A of the arm 74. Pad 82C is connected to the transmit drive source. There is 180 degrees of phase difference between the arm lengths of arms 72, 74 at the center frequency. The two ends of the spiral arms 72, 74 are driven 180 degrees out of phase. It is noted that, in this exemplary embodiment, the pad 82C is not located equidistant between the pads 82A and 82B since the difference in electrical length between the center pad and the two end pads is 180 degrees only at the center frequency of the outer spiral. This is a narrow band balun, and there will be some phase error at the upper and lower ends of the band of operation. A broad band balun could alternatively be used if the frequency band of operation is broad band. Such a broad band balun would use a magic tee coupler or a 180 degree hybrid type design.

Conductor line 84 with two small pads 86A, 86B and one large pad 86C is the filter and balun for the high frequency antenna 60. The small pads 86A, 86B are the attachment points for the coaxial cables which in turn attach to pads 62A, 64A feeding the center spiral 60. The thin conductor lines 84A, 84B transition into thicker conductor feed line 84C, and are attached to these pads 86A, 86B. The thin lines 84A, 84B are the balun and again have 180 degrees of phase length between their paths.

There are four open circuit conductor line stubs 88A, 88B, 90A, 90B attached to the feed line 84C like ribs on a spine. The stubs comprise the filter. The filter is a series of ¼ λ open circuit stubs separated by ½ λ of transmission line. The ¼ λ and ½ λ electrical lengths are at the center of the low frequency band of the outer spiral. The energy traveling down a stub travels ¼ λ, reflects without a phase change and returns to the start of the stub with a 180 degree phase shift. This reflected energy now cancels the incident energy of the transmission line. The more stubs on the line, the greater the cancellation effect. Additionally, stubs can be grouped together. The structure would look like a fan with the individual stubs separated at the ends but converging to the same point on the transmission line. To further enhance the filtering with stubs, the stubs (or stub clusters) are separated by ½ λ. The open circuit at the end of a stub is reflected to a short circuit at the beginning of the stub. ½ λ away, the short circuit is reflected to an open circuit. Consider a three port structure that is a transmission line ½ λ long with ¼ λ stubs at both ends. The input energy, which one is trying to block, sees a short down the path of the nearest stub. The second stub reflects back as an open circuit for the energy toward the through path. Hence, through the use of stubs, the undesirable energy is enticed to leave the transmission line for a short circuit stub, and is blocked by continuing down the transmission line by an open circuit created by the second stub. By putting multiples of this three ported device in series, one can achieve whatever filtering (isolation) value is desired.

More filters and baluns could be added with additional stripline layers if more spirals are needed for multiple frequency bands.

Figure 3:
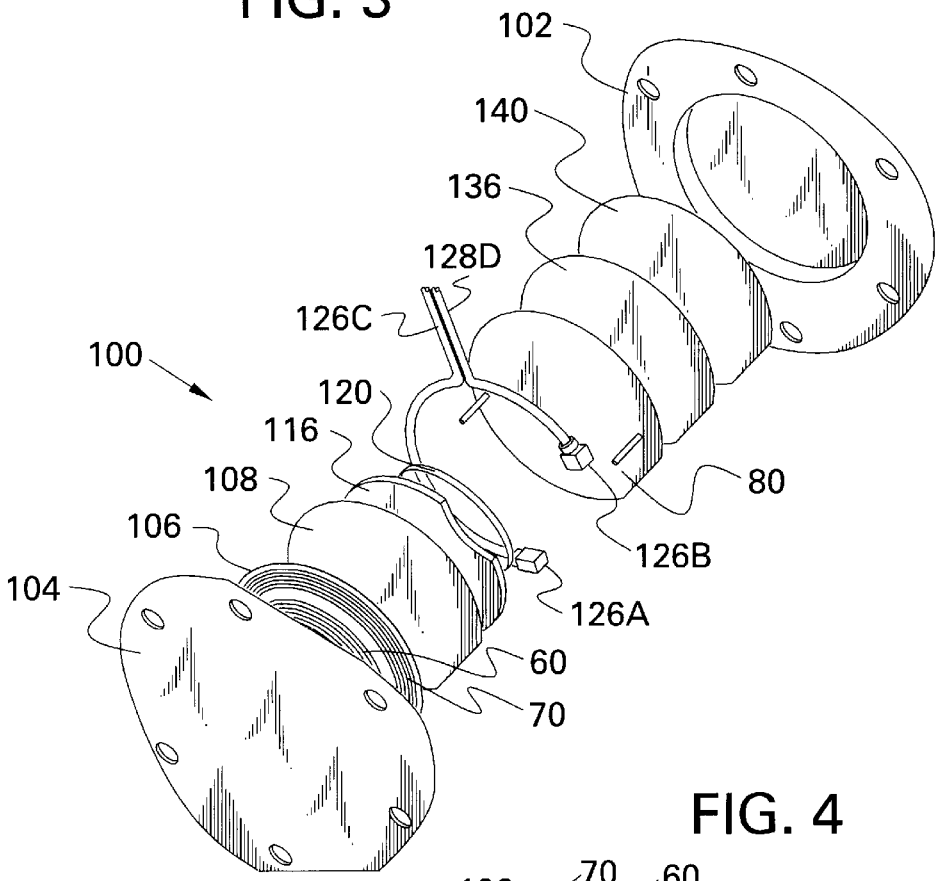
FIG. 3 is an exploded isometric view of an exemplary implementation of a multi-band spiral antenna embodying the invention.
Figure 4:
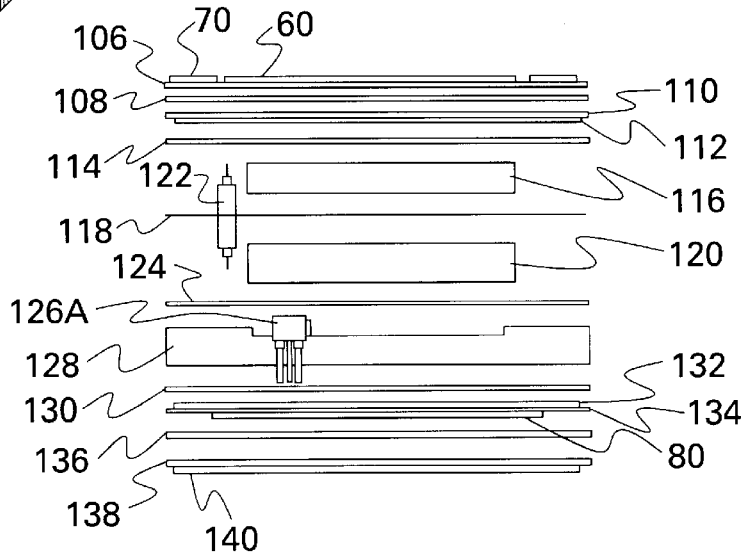
FIG. 4 is a side exploded view of the antenna of FIG. 3.

FIGS. 3 and 4 illustrate an exemplary implementation of a spiral antenna 100 embodying the invention. FIG. 3 is an exploded isometric view of the antenna elements, which are sandwiched between an antenna housing structure 102 and a radome 104. FIG. 4 is a side exploded view of the elements of the antenna 100. The spirals 60 and 70 are defined as copper conductor patterns etched from a copper layer on a dielectric substrate 106. In this embodiment, the substrate is bonded by bonding film 108 to an exposed surface of another dielectric substrate 110. A ground ring 112 is defined on the opposite surface of the substrate 110.

A circular slab of foam 116 is bonded to the ground ring and substrate 110 by bonding film 114. Surrounding the slab is a conductive isolation ring 120. A surface of a dielectric absorber slab structure 128 is bonded to the foam 116 by bonding film 118. The opposite surface of the absorber 128 is bonded by bonding film 130 to a ground plane 132 defined on a surface of substrate 134. The balun and filter circuits 80 are defined on the opposite surface of the substrate 134. An exposed surface of a dielectric substrate 138 is bonded to the surface of the circuits 80 by bonding film 136. A ground plane 140 is defined on the opposite side of the substrate 138.

An exemplary coaxial cable and termination resistor circuit 122 is illustrated in FIG. 4, for connection between a termination pad connected to a spiral arm and the ground plane 140. Element 126A illustrates a coaxial feed connector for connection to the filter/balun circuits 80. Coaxial line 126C and connector 126A (FIG. 3) are for feeding the lower frequency spiral 70. Coaxial line 126D and connector 126B (FIG. 3) are for feeding the interior spiral 60.

When the various elements of the antenna 100 are assembled together, the result is a compact, highly isolated multiple band antenna system, wherein the isolation between operating bands is achieved by elements located within the antenna body, which is generally defined by the housing 102 and radome 104.

A multiple band, multi-spiral antenna has been described, which uses filters to pass the band of one spiral and reject the band of the others. Additional isolation is achieved by arranging adjacent spirals to have opposite senses. The isolation is achieved by filters and balun circuits arranged within the body of the antenna. This minimizes the space required for the antenna. The antenna can achieve isolation between bands of over 70 dB even though the spirals for the different bands are concentric about each other and on the same plane. This isolation can be achieved, by way of example, in an embodiment wherein the frequency bandwidth of one spiral is 200 MHz, the bandwidth of the second spiral is 500 MHz, and the separation between the two bands is 300 MHz.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A multiple frequency band antenna system with isolation between multiple frequency bands of operation, comprising:

an interior spiral antenna comprising first and second spiral arms wound around a center axis, each arm having a feed end and a terminated end, said interior spiral antenna for operation at a first frequency band;

an outer spiral antenna comprising third and fourth spiral arms wound around said center axis and outward from said axis with respect to said interior spiral antenna, each spiral arm having a feed end and a terminated end, said outer spiral antenna for operation at a second frequency band which is lower in a frequency range than a corresponding frequency range of the first frequency band;

wherein said interior and outer spiral antennas are concentric about each other and are disposed on a common plane;

a balun and filter circuit, comprising a first balun for connecting a first frequency band drive signal to said interior spiral antenna, said first balun including a first transmission line circuit for connecting said first drive signal to said respective feed ends of said first and second spiral arms of the interior spiral antenna, a second balun for connecting a second frequency band drive signal to said outer spiral antenna, said second balun including a second transmission line circuit for connecting said second drive signal to said respective feed ends of said first and second spiral arms of the outer spiral antenna, and a filter circuit for providing isolation between signals of said first frequency band and said second frequency band.

2. The antenna system of claim 1 wherein said feed ends of said spiral arms of said interior antenna are located at interior ends of said spiral arms, and said interior antenna is center fed by said first balun.

3. The antenna system of claim 2 wherein said first balun is adapted to feed said respective interior ends of said spiral arms of said interior antenna with signals in anti-phase.

4. The antenna system of claim 3 wherein said first balun transmission line circuit includes transmission line segments which differ in effective electrical length by one half wavelength at a center frequency of operation of said interior spiral antenna.

5. The antenna system of claim 1 wherein said feed ends of said spiral arms of said outer antenna are located at outer ends of said spiral arms, and said outer antenna is fed from outside said outer antenna by said second balun.

6. The antenna system of claim 5 wherein said second balun is adapted to feed said respective interior ends of said spiral arms of said outer antenna with signals in anti-phase.

7. The antenna system of claim 6 wherein said second balun transmission line circuit includes transmission line segments which differ in effective electrical length by one half wavelength at a center frequency of operation of said outer spiral antenna.

8. The antenna system of claim 1 wherein said filter circuit includes a first transmission line stub extending from a transmission line segment of said first transmission line circuit, said stub having an effective electrical length equivalent to one quarter wavelength of a frequency of operation of said second frequency band.

9. The antenna system of claim 8 wherein said filter circuit includes a second transmission line stub extending from said transmission line segment of said first transmission line at a point spaced from said first stub a distance equivalent to an effective electrical length of one half wavelength at said frequency of operation of said second frequency band.

10. The antenna system of claim 1 wherein said first and second baluns and said filter circuit are defined on a planar stripline circuit board, said board located within the antenna body of the antenna system.

11. The antenna system of claim 10 wherein said first and second baluns are connected to said respective feed ends of said spiral arms of said interior and outer spiral antennas by coaxial cables.

12. A multiple frequency band antenna system with isolation between multiple frequency bands of operation, comprising:

an antenna housing structure;

an interior spiral antenna comprising first and second spiral arms wound around a center axis, each arm having a feed end and a terminated end, said interior spiral antenna for operation at a first frequency band;

an outer spiral antenna comprising third and fourth spiral arms wound around said center axis and outward from said axis with respect to said interior spiral antenna, each spiral arm having a feed end and a terminated end, said outer spiral antenna for operation at a second frequency band which is lower in a frequency range than a corresponding frequency range of the first frequency band;

wherein said interior and outer spiral antennas are concentric about each other and are disposed on a common plane;

a balun and filter circuit, comprising a first balun for connecting a first frequency band drive signal to said interior spiral antenna, said first balun including a first transmission line circuit for connecting said first drive signal to said respective feed ends of said first and second spiral arms of the interior spiral antenna, a second balun for connecting a second frequency band drive signal to said outer spiral antenna, said second balun including a second transmission line circuit for connecting said second drive signal to said respective feed ends of said first and second spiral arms of the outer spiral antenna, and a filter circuit for providing isolation between signals of said first frequency band and said second frequency band, said first and second baluns and said filter circuit defined on a planar circuit board, said board situated in parallel to said common plane of said spiral antennas and located within the antenna housing structure.

13. The antenna system of claim 12 wherein said feed ends of said spiral arms of said interior antenna are located at interior ends of said spiral arms, and said interior antenna is center fed by said first balun.

14. The antenna system of claim 13 wherein said first balun is adapted to feed said respective interior ends of said spiral arms of said interior antenna with signals in anti-phase.

15. The antenna system of claim 14 wherein said first balun transmission line circuit includes transmission line segments which differ in effective electrical length by one half wavelength at a center frequency of operation of said interior spiral antenna.

16. The antenna system of claim 12 wherein said feed ends of said spiral arms of said outer antenna are located at outer ends of said spiral arms, and said outer antenna is fed from outside said outer antenna by said second balun.

17. The antenna system of claim 16 wherein said second balun is adapted to feed said respective interior ends of said spiral arms of said outer antenna with signals in anti-phase.

18. The antenna system of claim 17 wherein said second balun transmission line circuit includes transmission line segments which differ in effective electrical length by one half wavelength at a center frequency of operation of said outer spiral antenna.

19. The antenna system of claim 12 wherein said filter circuit includes a first transmission line stub extending from a transmission line segment of said first transmission line circuit, said stub having an effective electrical length equivalent to one quarter wavelength of a frequency of operation of said second frequency band.

20. The antenna system of claim 19 wherein said filter circuit includes a second transmission line stub extending from said transmission line segment of said first transmission line at a point spaced from said first stub a distance equivalent to an effective electrical length of one half wavelength at said frequency of operation of said second frequency band.

21. The antenna system of claim 12 further comprising a dielectric radome structure covering said interior and outer spiral antennas.

* * * * *